US006786126B2

(12) United States Patent
Sargent

(10) Patent No.: US 6,786,126 B2
(45) Date of Patent: Sep. 7, 2004

(54) BALLISTIC RESISTANT MATERIALS AND METHOD OF MANUFACTURE

(76) Inventor: Wayne B. Sargent, 552 Laurenburg La., Ocoee, FL (US) 34761

( * ) Notice: Subject to any disclaimer, the term of this patent is extended or adjusted under 35 U.S.C. 154(b) by 0 days.

(21) Appl. No.: 10/068,737

(22) Filed: Feb. 5, 2002

(65) Prior Publication Data

US 2004/0144244 A1 Jul. 29, 2004

Related U.S. Application Data

(60) Provisional application No. 60/266,544, filed on Feb. 5, 2001, and provisional application No. 60/332,273, filed on Nov. 14, 2001.

(51) Int. Cl.[7] ..... F41H 5/04

(52) U.S. Cl. ..... 89/36.02; 89/36.05; 2/2.5

(58) Field of Search ..... 89/36.02, 36.05; 2/2.5

(56) References Cited

U.S. PATENT DOCUMENTS

| | | | | |
|---|---|---|---|---|
| 3,778,845 A | * | 12/1973 | Miller | 2/236 |
| 3,826,172 A | * | 7/1974 | Dawson | 109/82 |
| 3,841,954 A | * | 10/1974 | Lawler | |
| 4,522,871 A | * | 6/1985 | Armellino, Jr. et al. | 2/2.5 |
| 4,660,223 A | | 4/1987 | Fritch | |
| 4,737,402 A | | 4/1988 | Harpell et al. | |
| 4,989,266 A | * | 2/1991 | Borgese et al. | 2/2.5 |
| 5,327,811 A | * | 7/1994 | Price et al. | 89/36.05 |
| 5,395,671 A | | 3/1995 | Coppage, Jr. et al. | |
| 5,591,933 A | * | 1/1997 | Li et al. | 89/36.02 |
| 5,723,201 A | | 3/1998 | Czetto, Jr. | |
| 5,926,842 A | | 7/1999 | Price et al. | |
| 6,127,291 A | | 10/2000 | Coppage, Jr. et al. | |
| 6,164,181 A | | 12/2000 | Bruner | |
| 6,227,257 B1 | | 5/2001 | Griffiths | |
| 6,248,676 B1 | | 6/2001 | Dischler | |
| 6,276,254 B1 | | 8/2001 | Cordova et al. | |
| 6,319,862 B1 | | 11/2001 | Czetto, Jr. | |

OTHER PUBLICATIONS

"Selection and Application Guide to Police Body Armor"; The National Institute of Justice's National Law Enforcement and Corrections Technology Center; Rockville, MD., pp. 1–90; Oct. 1998.

* cited by examiner

*Primary Examiner*—Stephen M. Johnson
(74) *Attorney, Agent, or Firm*—Haynes and Boone, LLP

(57) ABSTRACT

A lightweight ballistic resistant materials and method of making the same are provided. The material includes at least two layers of penetration resistant material intermittently connected to form areas of connection between the material and much larger areas of material where there is no connection between the adjacent layers. The intermittently connected material may be used as a component of composite ballistic panels or may be utilized alone to provide penetration protection.

14 Claims, 9 Drawing Sheets

BALLISTIC RESISTANT MATERIALS AND METHOD OF MANUFACTURE

This application claims priority to U.S. Provisional Application Nos. 60/266,544 filed Feb. 5, 2001 now abandoned and 60/332,273 filed Nov. 14, 2001 now abandoned.

This invention relates to armor products that can achieve realistic missile penetration criteria while reducing the weight and/or volume of the material necessary to achieve the desired results. Methods for making such armor products are also provided.

There continues to be a demand for protection against ballistic projectiles, including bullets, bomb fragments and other flying objects. With the advancement of technology, particularly composite materials using fibers and laminates, armor that is much lighter than equivalent steel protection has become available and is presently utilized to provide limited protection for the human body, aircraft, vehicles and many other applications. As will be appreciated by those skilled in the art, there continues to be a demand for still further ballistic resistant products that can achieve realistic missile penetration criteria while reducing the weight and/or volume of the material necessary to achieve the desired results.

The present invention contemplates penetration resistant material capable of resisting high velocity impacts from flying missiles such as bullets, shrapnel, debris, etc. In one aspect, the present invention is directed to a ballistic panel formed of at least one layer of woven ballistic resistant material and at least one layer of non-woven ballistic resistant material. Still further, it is preferred that the layers are intermittently connected to form relatively large areas of substantially unconnected material surrounded by smaller areas of connected material. The present invention is further directed to composite devices comprising at least two panels formed of at least two layers of such penetration resistant material.

In one embodiment of the invention, but without limitation to the use of alternative materials, the penetration resistant material of the ballistic panel may comprise at least one layer of Spectra material. The ballistic panel may further comprise at least one layer of Kevlar material. The ballistic panel may comprise at least one or more layers of Kevlar and a greater number of Spectra layers. In a specific embodiment, the ballistic panel may comprise three Kevlar layers and ten Spectra layers. Furthermore, the ballistic panel may be assembled by combining the intermittently connected penetration resistant layers of Kevlar and Spectra with laminated layers of penetration resistant material.

In one embodiment, the at least two layers of penetration resistant material may be joined by a filament. In one aspect, the filament (or filaments) may be used to sew a pattern of connection between the first layer and the second layer defining relatively large areas of unconnected layers bounded by substantially smaller areas of interconnected material.

In still a further aspect of the invention, a ballistic panel comprises a first projectile deformation layer and at least one additional layer of pliable penetration resistant material. The projectile deformation layer may comprise a metallic sheet while the pliable layer may comprise thermoset Kevlar material.

Still further, another aspect of the invention comprises a ballistically modified seat cover. The seat cover may be formed of the lightweight, penetration resistant devices described herein. The seat cover is sufficiently flexible and quick-detachable so as to be readily usable for a variety of other uses such as covering a user.

The present invention also contemplates a foldable panel formed of ballistic resistant material. In one aspect, such a foldable panel may include rigid stiffeners to limit collapse. Further, fasteners may be provided on the foldable panel to join it to support structures or additional panels of similar construction.

These and other objects and advantages of the present invention will become apparent from the following description of the preferred embodiments.

DETAILED DESCRIPTION

Figure 1:
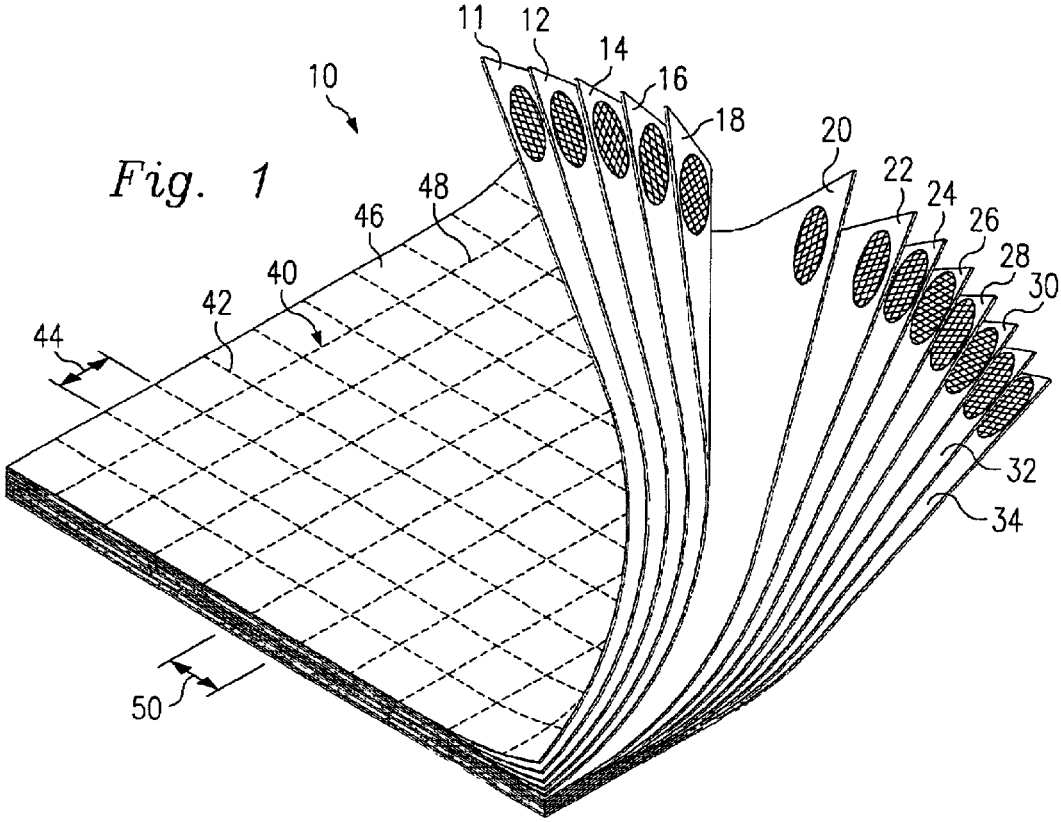
FIG. 1 is a partially exploded perspective view of a penetration resistant panel according to the present invention.

Referring to FIG. 1, there is shown a lightweight ballistic panel 10 constructed in accordance with the present invention. Ballistic panel 10 includes a first layer of penetration resistant material 11 and a second layer of penetration resistant material 12. In a preferred aspect, the penetration properties of layer 11 may differ from those of layer 12. In one aspect, penetration resistant material 11 is a woven fabric having significant anti-ballistic properties and penetration resistant material 12 is a non-woven material having significant anti-ballistic properties. Preferably, layer 11 may be formed of Kevlar 29 brand fiber from DuPont and layer 12 may be formed of Spectra Shield LCR brand material from Allied Signal. For ease of reference, Kevlar 29 is understood to be Style 713, Plain Weave, 8.3 oz/square yard, 31×31 thread count. Spectra Shield LCR is understood to be a unidirectional polyethylene fiber of approximately 0.007±0.002 inch diameter with an area density of 4.42 ±0.29 oz/square yard. As shown in FIG. 1, the illustrated embodiment includes layers 11, 12, 14, 16, 18, 20,22,24,26, 28, 30, 32, and 34 with layers 11, 22 and 34 being formed of Kevlar 29 and layers 12–20 and 24–32 being formed of Spectra Shield LCR.

The Spectra Shield LCR layers 12–20 and 24–32 may have a fiber orientation of 0°×90°. Alternatively, the Spectra Shield LCR layers may have fiber orientations of 90°×90° and 45°×45°. More specifically, layers 12, 16, 20, 24, 28, and 32 may be Spectra Shield LCR with a fiber orientation of 90°×90°, and layers 14, 18, 26, and 30 may be Spectra Shield LCR with a fiber orientation of 45°×45°.

The layers 11–34 illustrated in FIG. 1 are selectively joined by a series of connectors 40 extending through all 13 layers. A first series of parallel connectors 42 extend linearly in a first direction across the material and extend from layer 11 through all the layers to layer 34. The connectors 42 extend in a substantially parallel manner and are spaced from one another by distance 44. In one embodiment, the distance 44 is one inch. In order to form bounded areas of unconnected material 46, a second series of connectors 48 extend linearly in a second direction across the material and extend from layer 11 through all the layers to layer 34. The connectors 48 extend in a substantially parallel manner and are spaced from one another by distance 50. In one embodiment, the distance 50 is one inch. Furthermore, the connectors 42 and 48 may be substantially perpendicular to each other. Thus, a quilting pattern may be formed on the material as squares of unconnected penetration resistant material 46 are bounded on all sides by material that has been joined by connectors.

In the embodiment described in FIG. 1, the connector 40 may be a filament formed of Kevlar or Spectra material. It is further contemplated that the connector could be any known filament such as high-strength cotton thread, metallic filaments, polymer plastic filaments, or any other suitable filament that may be utilized to join the adjacent layers. The filament (or filaments) may further be utilized in overlapping linear patterns to form a substantially quilted connection of the at least two layers. It is contemplated that the quilted pattern may contain a plurality of substantially square or rectangular areas of unconnected material. While square areas are shown in the embodiments, other geometric or non-uniform patterns are contemplated to achieve the same result, for example but without limitation, triangular, diamond, pentagon, hexagon, and octagon patterns are examples of such possible alternatives. Still further, while intersecting filament segments are disclosed in the embodiments illustrated herein, it is contemplated that substantially linear filament segments, without intersection, can be utilized to join the adjacent materials. Still further, the areas of connected material may be isolated areas within the overall fabric or they may be interconnected with one another to define a pattern. The connection between the at least two layers may be formed by filaments, adhesive, bonding agents, rivets, glue, or any other means of joining one or more layers of material.

The choice of filament selection for joining the layers to form a composite panel may take into consideration both ballistic properties and environmental resistance properties, such as resistance to chemicals, rot, ultraviolet light, etc. In testing, cotton thread demonstrated acceptable ballistic properties during projectile impact by yielding or breaking to permit motion between the adjacent layers. However, cotton is susceptible to rot, particularly in humid conditions. Thus, other fibers having sufficient strength to hold the layers together during use but sufficiently weak to break upon impact of a projectile may be used in one aspect of the present invention. In a preferred aspect, loose connection between the layers of different materials provides improved ballistic performance by permitting motion between the layers such that they work independently upon projectile impact but inhibit finding a common path through the layers.

While the embodiment of FIG. 1 specifically mentions and contemplates the use of Kevlar 29 and Spectra Shield LCR, other materials are contemplated for use in constructing a device according to the present invention. It is contemplated that for most anticipated applications the penetration resistant materials have the ability to stop firearm bullets and other high-velocity projectiles. More specifically, some suitable alternative materials may include, but are not limited to, Kevlar Style 710, Plain Weave 9.4 oz/square yard with a 24×24 thread count; Style 729, Plain Weave, 6.5 oz/square yard, 17×17 thread count; and Style 745, Plain Weave 13.6 oz/square yard, 17×17 thread count. Numerous ballistic resistant materials are available from different manufactures which may find application in the present invention. Such materials may include woven and non-woven fabric comprising fibers of very high molecular weight polymers, suitably polyolefins, such as polyethylene or high molecular weight polypropylene, PBO resins and/or aramid polymers. These fabrics are sold commercially under such names as "Spectra", "Protera", "Kevlar", "Zylon", "Gold Shield", "TWARON" and "Dyneema". A more detailed listing of suitable ballistic resistant materials is set forth in U.S. Pat. No. 6,127,291 which is incorporated herein by reference in its entirety. Still further, while 13 layers have been shown in one aspect of the present invention illustrated in FIG. 1, it is contemplated that more or less layers in different combinations may be utilized without deviating from the present invention.

Figure 2:
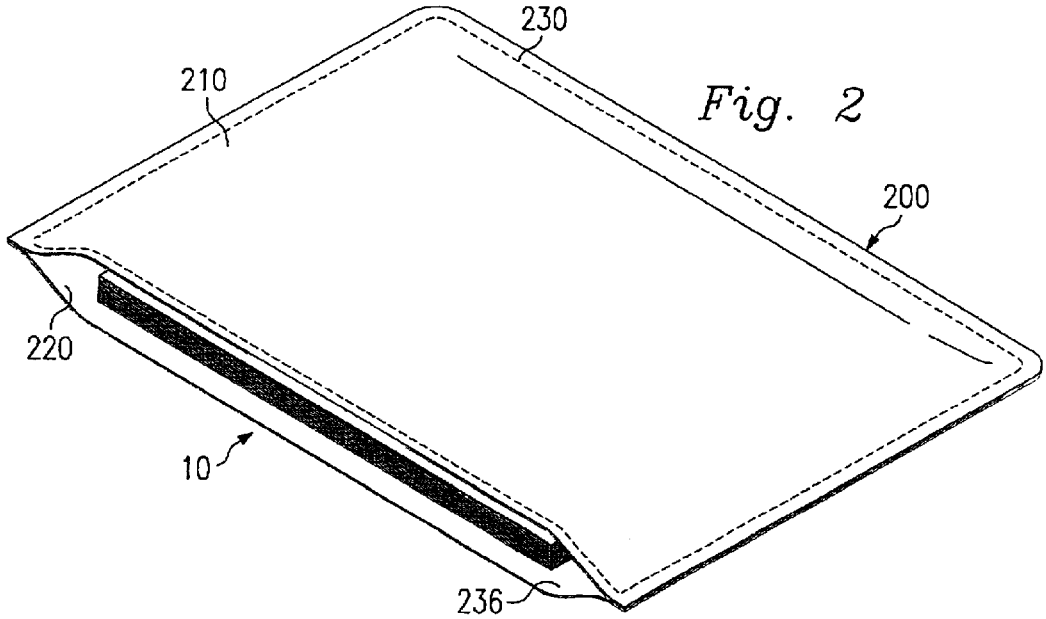
FIG. 2 is a perspective view of a panel according to FIG. 1 inserted within an outer sheath.

Referring now to FIG. 2, panels constructed in accordance with the teachings of FIG. 1 may be inserted into a substantially rectangular sheath 200 for thermal and chemical protection. Sheath 200 may be constructed of a pair of layers of Orcofilm AN-4C. A first layer 210 is joined to a second layer 220 by stitching 230. Stitching 230 extends around three sides of the sheath 200 leaving an opening 236 along at least one edge for insertion of the panel 10. Once the panel 10 is inserted through opening 236, the stitching 230 is extended along the previously open side to enclose the ballistic panel. The stitching of layer 210 to 220 may be conducted with six stitches per linear inch and may be of a thread formed of Kevlar or Spectra filament.

Figure 3:
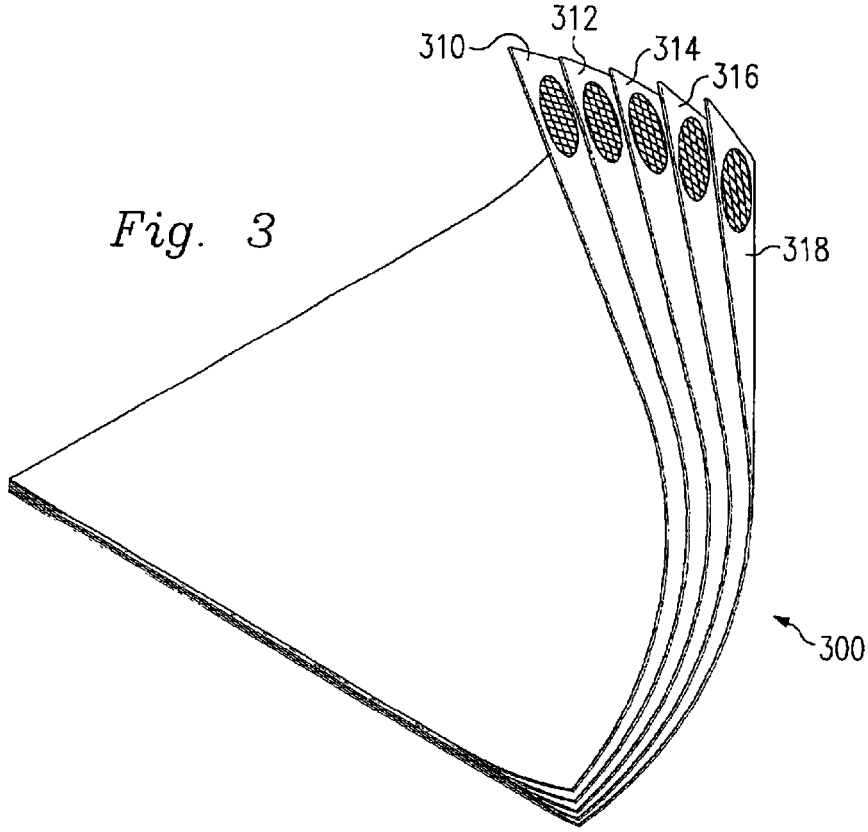
FIG. 3 is a partially exploded perspective view of a hardened penetration resistant panel according to the present invention.

Referring now to FIG. 3, there is shown a hard coupon of ballistic penetration resistant material intended for application with the present invention for creating composite ballistic panels. More specifically, hard coupon 300 may be formed of five sheets 310–318 of a penetration resistant material. This penetration resistant material may be Kevlar 29 90°×90°. While this material is shown for the purposes of illustration in the present invention, it is contemplated that missile penetration resistant materials of any type may be utilized with the present invention. The layers of coupon 300 may be interconnected via lamination (not shown) using FAR-certified laminates. More specifically, the resin may be Ciba Specialty Chemist Epoxy CG1304 resin with a hardener of H956 or substantially equivalent resins. It is contemplated that hard coupon 300 has substantially uniform lamination between the layers to form a substantially uniform material.

Figure 4:
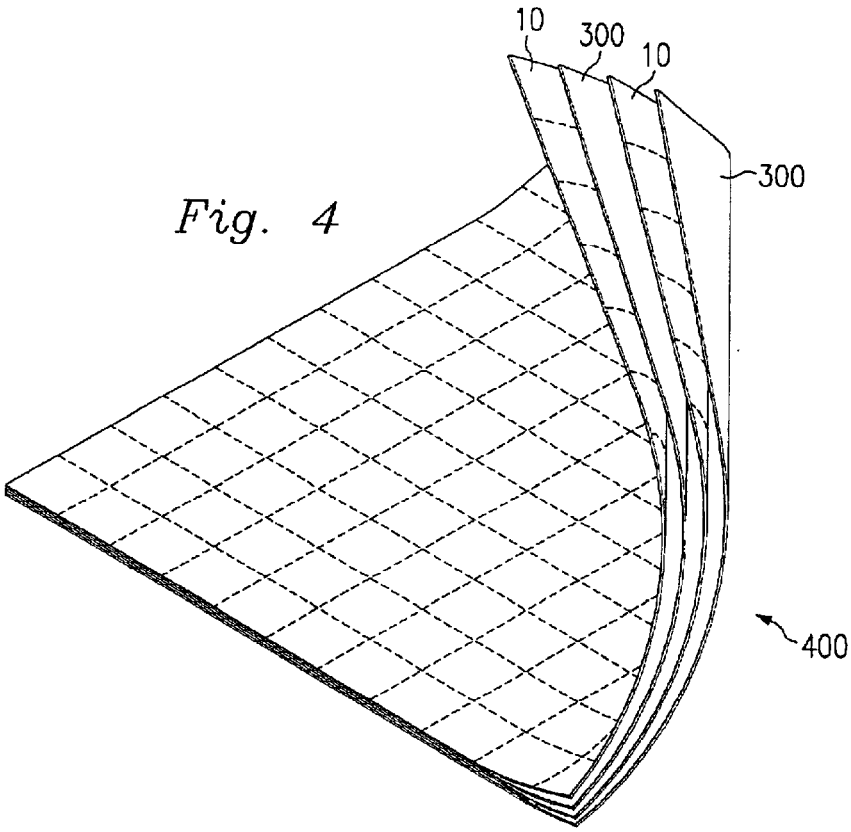
FIG. 4 is a partially exploded perspective view of a composite panel according to another aspect of the present invention.

FIG. 4 shows a composite ballistic panel 400 constructed in accordance with another aspect of the present invention. Composite ballistic panel 400 includes a first panel 10 (as shown in FIG. 1), a second panel 300 (as shown in FIG. 3), a third panel 10, and a fourth panel 300.

Figure 5:
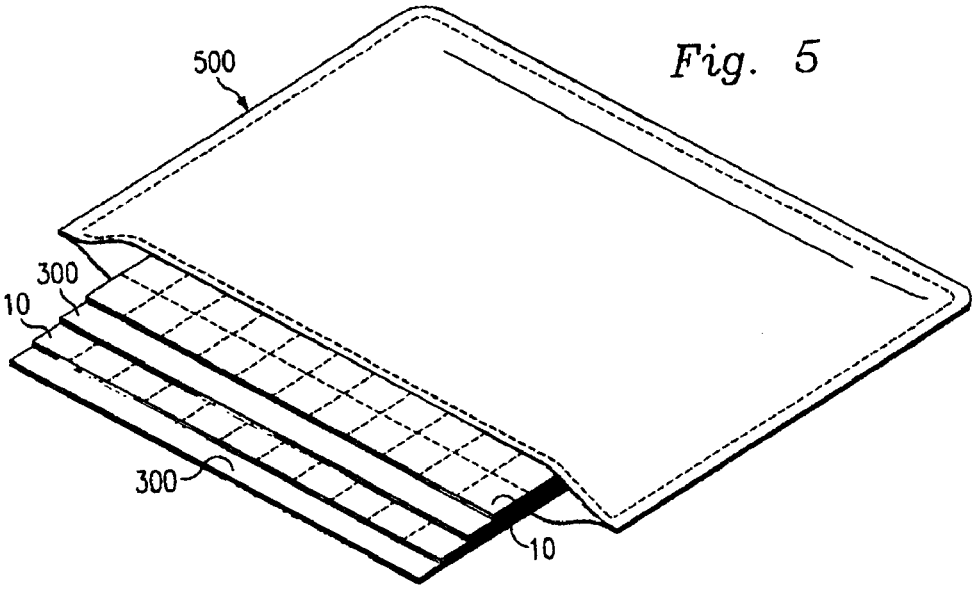
FIG. 5 is a perspective view illustrating the panel of FIG. 4 inserted within a protective sheath.

Referring now to FIG. 5, the composite ballistic panel 400, constructed in accordance with FIG. 4, may be inserted into a protective sheath 500, formed as previously described with respect to FIG. 2. Preferably, sheath 500 maintains the four panels in close proximity to each other without the need for attachment between adjacent panels.

Figure 6:
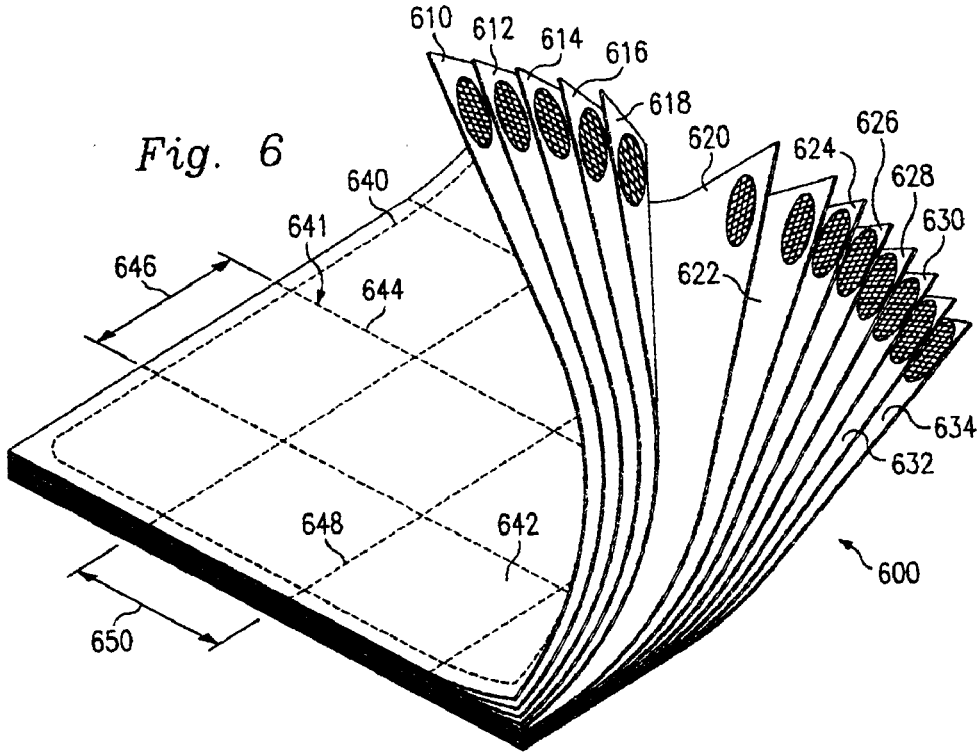
FIG. 6 is a partially exploded perspective view of yet a further embodiment of a panel according to the present invention.

Referring now to FIG. 6, there is shown still a further embodiment according to the present invention. Panel 600 includes 13 layers 610, 612, 614, 616, 618, 620, 622, 624, 626, 628, 630, 632, and 634 consistent with layers 11–34 of FIG. 1. Panel 600 differs from panel 10 by the type of material used as the filaments for joining the layers 610–634 and by the manner in which the layers are joined. More specifically, panel 600 contemplates using a filament of high-strength cotton 640 to join the perimeter of the 13 layers disclosed in this embodiment A filament of high strength cotton 641 is further used to interconnect the layers 610–634 in a quilting pattern on the panel 600, thereby defining squares of unconnected material 642. The spacing between parallel extending connector 644 is a distance 646. In one embodiment, the distance 646 is three inches. In a similar manner, parallel extending connector 648 is spaced by a distance 650. In one embodiment, the distance 650 is three inches. Thus, the individual squares of unconnected material 642 have a surface area of nine square inches. The surface area of unconnected material 642 is therefore many times greater than the surface area of the material that is joined by connectors 644 and 648. It will be understood that the distances described herein are given for illustration purposes only and that these distances may vary.

Furthermore, it is contemplated that the connectors used to join the layers of panel 600 form a substantially looser connection between the layers 610–634 than traditional lamination of the layers. More specifically, it is contemplated that given the tension applied to connectors 644 and 648 there is the possibility for micro-motion between the layers that may facilitate flexibility of panel 600 as well as the possibility of energy transfer upon the impact of a ballistic missile.

Figure 7:
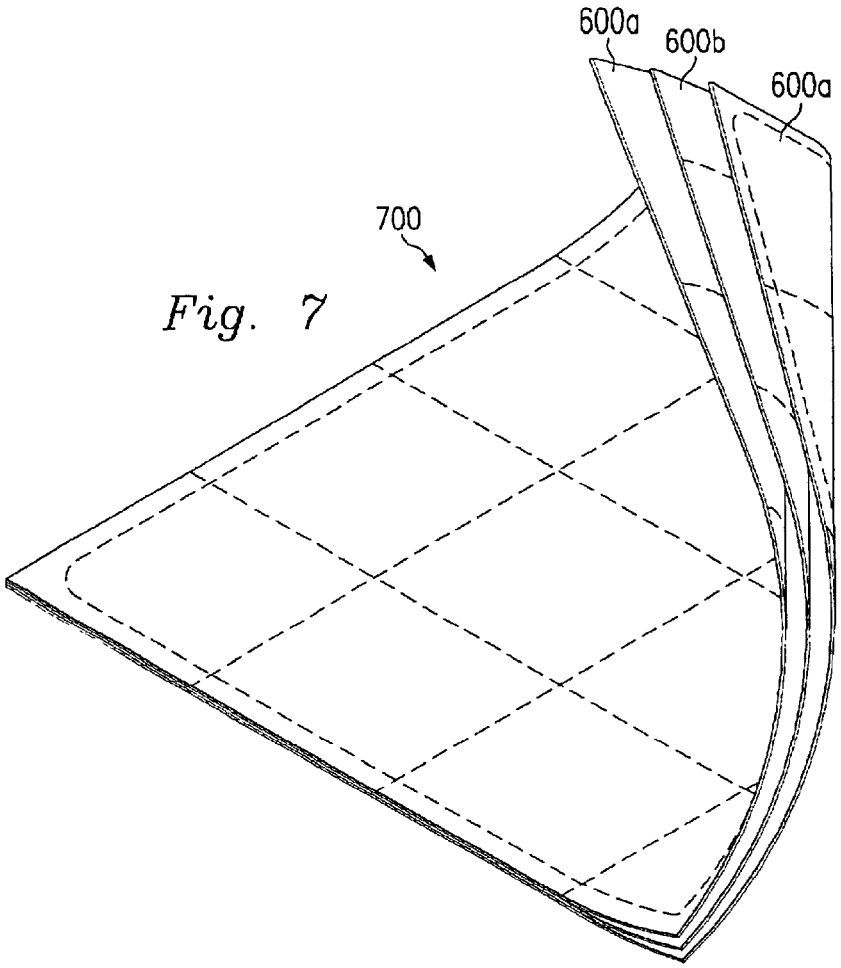
FIG. 7 is a partially exploded perspective view of a composite panel utilizing the panel of FIG. 6.
Figure 8:
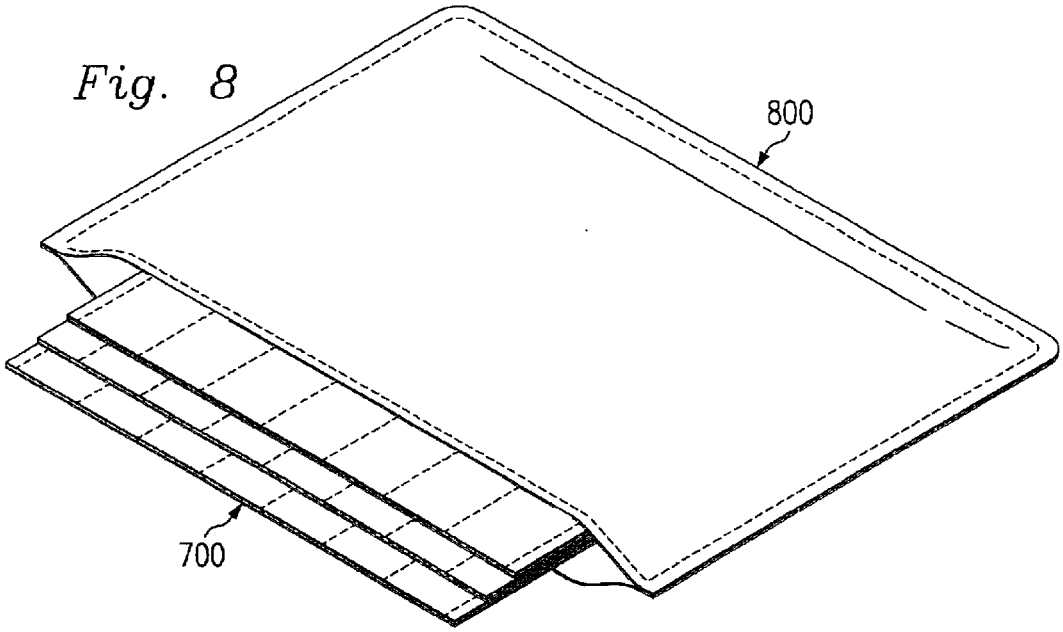
FIG. 8 is a perspective view showing the composite panel of FIG. 7 inserted within a protective sheath.

A composite ballistic panel 700 according to the present invention is shown in FIG. 7. Composite panel 700 comprises three panels of the embodiment shown in FIG. 6. As shown in FIG. 7, panels 600*a* are aligned such that their connection patterns are substantially in alignment. However, panel 600*b* is offset with respect to the connection patterns of panel 600*a*. In one embodiment, the offset is approximately 1.5 inches in both directions. It will be understood that staggering the connection patterns may provide greater penetration resistance as this orientation limits the common path through which an object may pass wholly through the panel. FIG. 8 shows the composite panel 700 inserted into a sheath 800 to provide a protective covering for the panel. The sheath is formed as previously described with respect to FIGS. 2 and 5.

Figure 9:
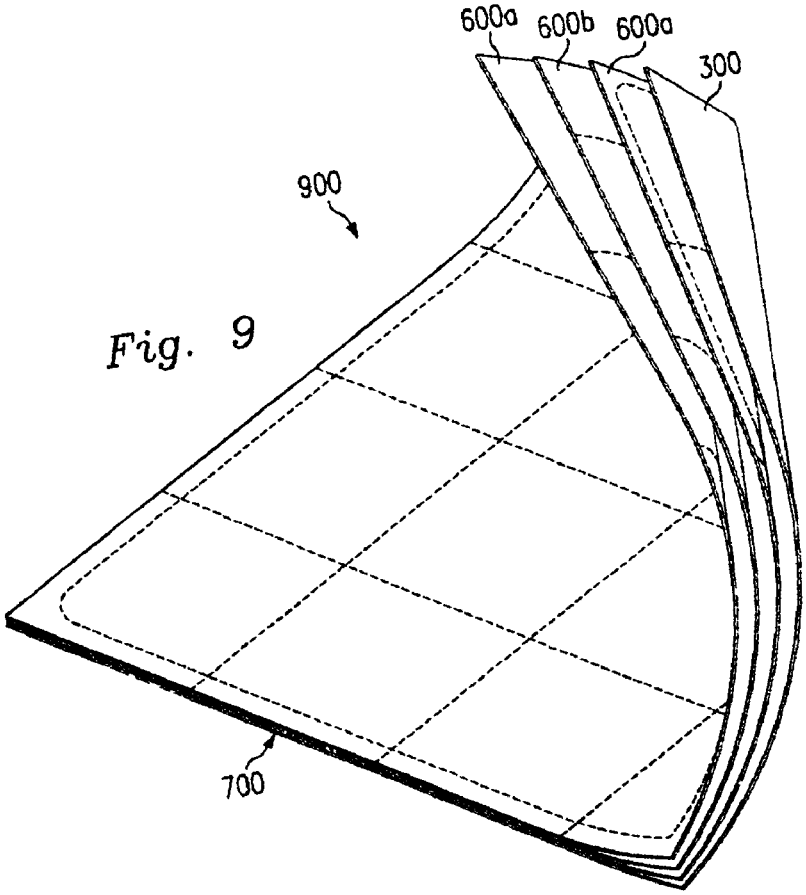
FIG. 9 is a partially exploded perspective view of a composite panel utilizing the panels of FIGS. 3 and 6.
Figure 10:
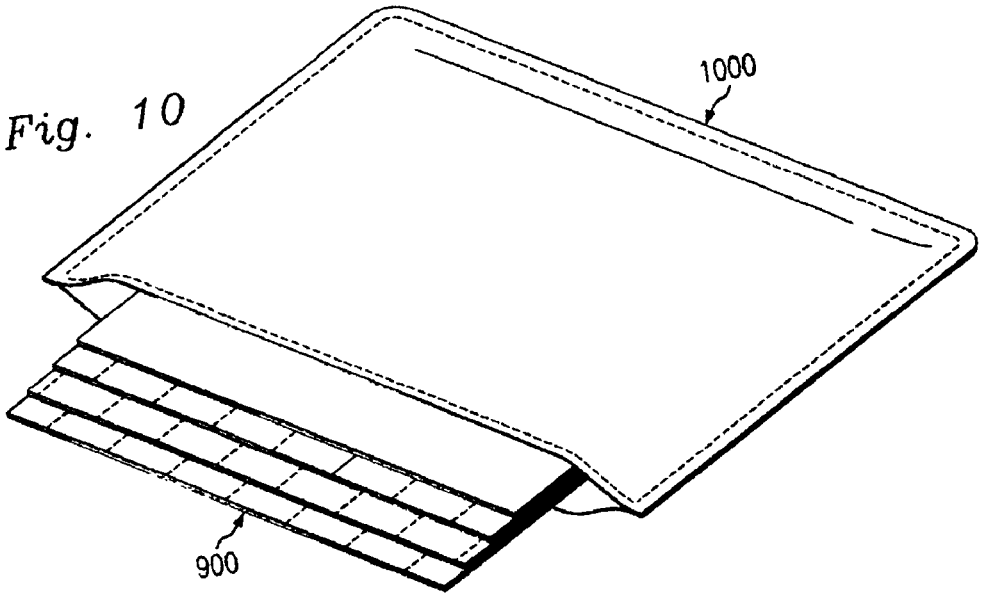
FIG. 10 is a perspective view showing the composite panel of FIG. 9 inserted within a protective sheath.

FIG. 9 illustrates still a further embodiment of a composite ballistic panel 900 formed in accordance with the present invention. Composite panel 900 includes three panels constructed in accordance with the embodiment shown in FIG. 6. As previously described with respect to the embodiment shown in FIG. 7, panels 600*a* and 600*b* have their connection patterns offset or staggered in both directions. In one embodiment, the offset is 1.5 inches. Composite panel 900 further includes a hard coupon 300, which may be constructed in accordance with FIG. 3. As shown in FIG. 10, composite panel 900 may be inserted into sheath 1000 to provide a protective covering for the panel.

Testing of the panel 700 shown in FIGS. 7 and 8 has demonstrated that it can consistently stop projectiles from all handgun calibers and the lower high-powered rifle caliber based upon the NATO round of 7.6 mm impacting at a velocity of 838 m/s (SKS and AK 47 rifles), as close as 100 yards. In a similar manner, the panel 900 shown in FIGS. 9 and 10 has also been shown to meet or exceed the same criteria.

The penetration stopping effects of the disclosed embodiments are achieved at panel weights that are substantially less than those presently available on existing products. In contrast, the embodiment shown in FIG. 8 has a weight of 1.48 pounds per square foot and the embodiment shown in FIG. 10 has a weight of 1.89 pounds per square foot. Ballistic panel 10 and composite ballistic panel 700 maintain their flexibility. It will be understood that this allows the material according to the present invention to have applications in clothing for personal protection, drapes, blankets, and other applications for traditional cloth where penetration protection is desired. Still further, the flexibility of the material according to the present invention may also allow it to have greater applicability in manufacturing or retrofitting mechanical components, vehicles, buildings, structures, containment systems, or other devices where it is cost prohibitive to individually mold pieces that are made to custom fit their application.

Figure 11:
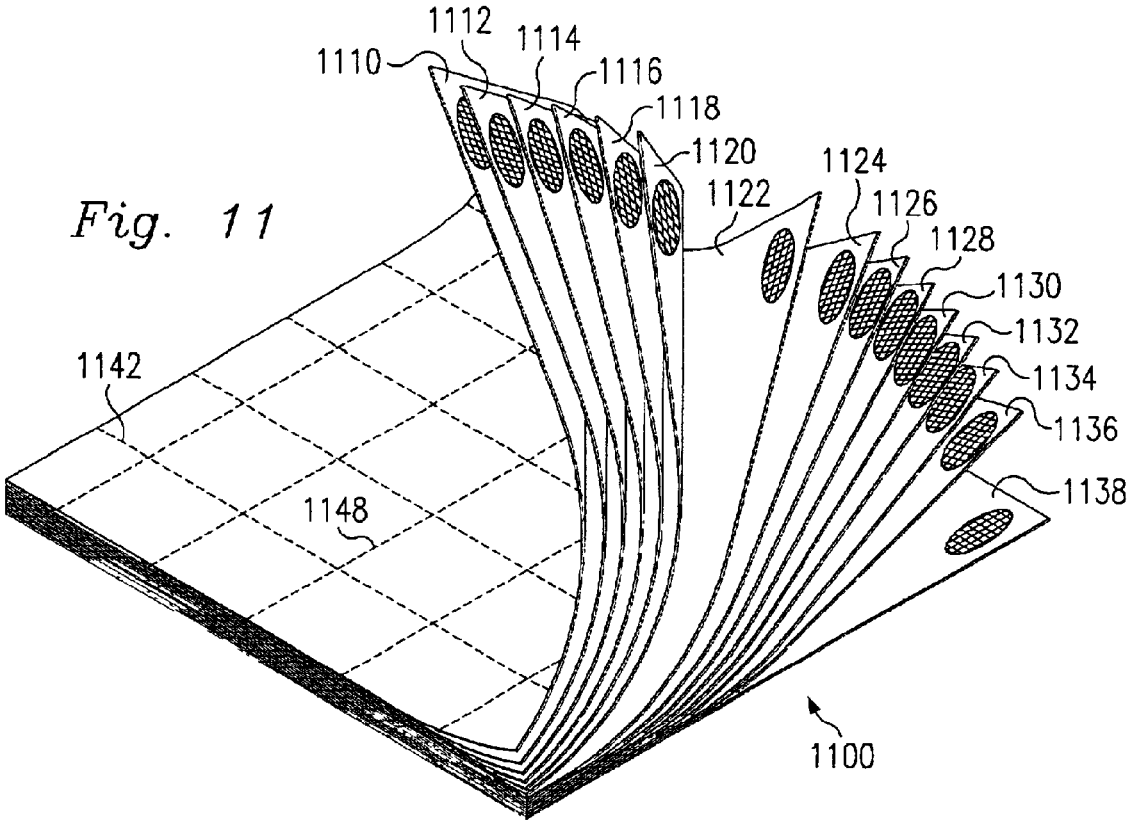
FIG. 11 is a partially exploded perspective view of a penetration resistant panel according to another aspect of the present invention.

Reference is now made to FIG. 11 showing a further embodiment of the applicant's invention. More specifically, there is shown a further ballistic panel 1100 according to the present invention. In one embodiment, panel 1100 comprises a combination of 15 penetration resistant layers intermittently connected with a first series of connectors 1142 and a second series of connectors 1148. The first layer 1110 is composed of Kevlar 29. The next three layers 1112–1116 are composed of hex form S745, a thermoset Kevlar fabric. The next eight layers 1118–1132 are formed of Spectra material, such as Spectra Shield LCR. The bottom three layers 1134–1138 are formed of hex form S745 thermoset Kevlar fabric. The wrap direction of the adjacent layers is zero to 90 degrees from one another as they are stacked on each other. The panel 1100 may be constructed as previously described with respect to the embodiments discussed above.

Figure 12A:
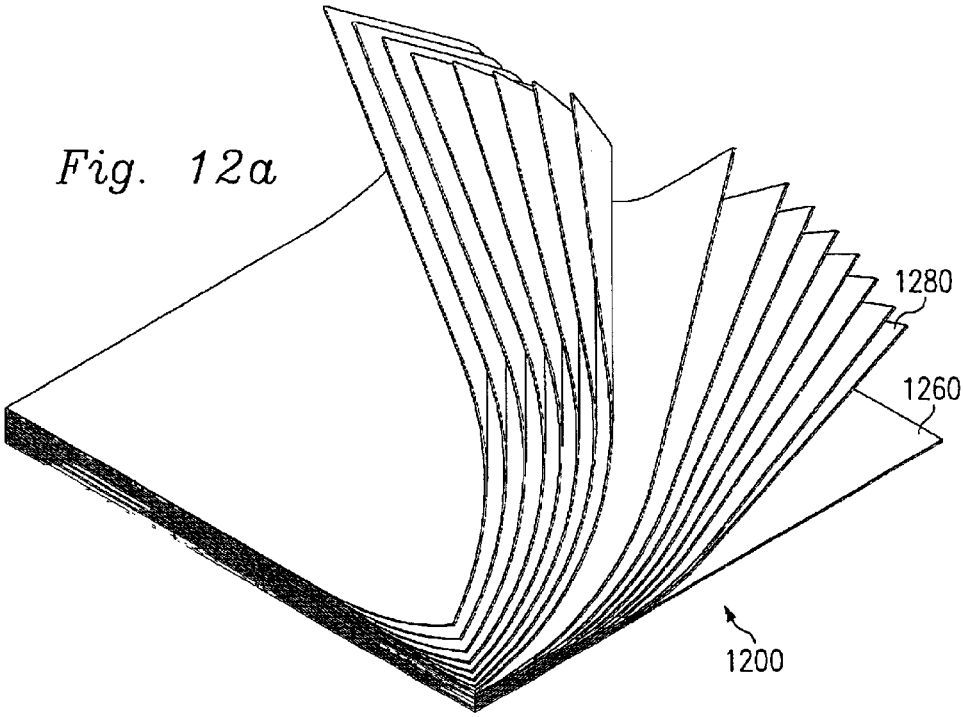
FIGS. 12(*a*) and 12(*b*) are partially exploded perspective views of still further penetration resistant panels according to another aspect of the present invention.
Figure 12B:
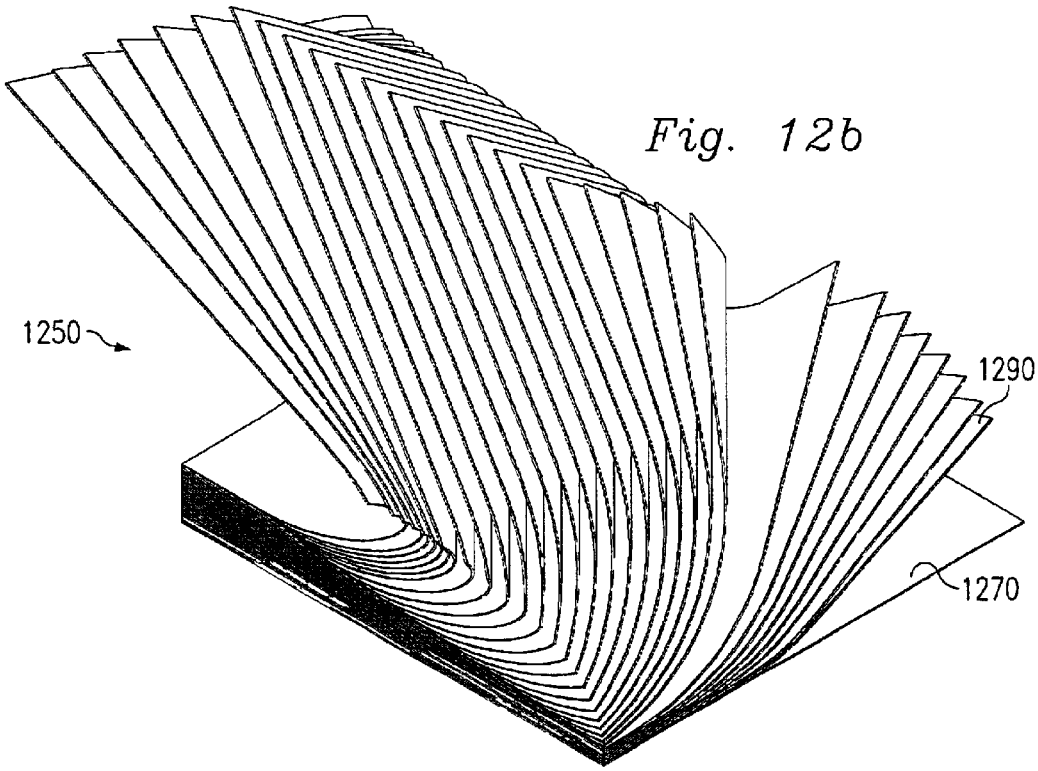

Referring now to FIGS. 12(*a*) and 12(*b*), there is shown still farther embodiments of the present invention. Panels 1200 and 1250 are shown having a projectile deformation layer 1260 and 1270, respectively, as the initial layer of the panels. Furthermore, each panel 1200 and 1250 comprises at least one layer of S745 thermoset Kevlar material 1280 and 1290, respectively. In the embodiment depicted in FIG. 12(*a*), sixteen layers of S745 thermoset Kevlar material are attached to the back of the projectile deformation layer 1260. In the embodiment depicted in FIG. 12(*b*), thirty-two layers of S745 thermoset Kevlar material are attached to the back of the projectile deformation layer 1270. Projectile deformation layers 1260 and 1270 have been selected to address specific threat levels. In one preferred aspect of the invention, projectile deformation layer is a pliable metallic sheet. It is contemplated that the metallic sheet and backing layers may be generally conformed to approximate adjacent support structures in vehicles and buildings. More specifically, projectile deformation layer 1260 may be formed of a 0.062 inch thick titanium sheet. For panel 1250, projectile deformation layer 1270 may be formed of a 0.125 inch thick titanium sheet.

Panels 1200 and 1250 are formed by utilizing the thermoset characteristics of the S745 thermoset Kevlar to bond the individual Kevlar layers to one another. The bonded Kevlar layers may be bonded to the projectile deformation layer utilizing an aerospace contact cement and where necessary localized bolting attachment points. It is contemplated that the bolting attachment points may conform to the bolt pattern of the vehicle or aircraft to which the material may ultimately be joined.

Experiments have shown that utilization of a projectile deformation layer, such as a titanium sheet, creates an extremely tough initial barrier that acts to deform the bullet or other projectile to increase its surface area and limit its ability to pass through the remaining soft layers. After the projectile passes through the projectile deformation layer 1260 or 1270, the deformed projectile may then be captured within the layers 1280 or 1290. Experimentation has shown that with the panel 1200, full metal jacket rounds of 7.62 millimeters by 39 millimeters may be stopped before exiting the layers 1280. Panel 1200, as shown in FIG. 12(*a*), has a weight of 3.71 pounds per square foot. In a similar manner, panel 1250 has been shown to stop full metal jacket or NATO rounds of 0.308 and weighs 5.75 pounds per square foot. The stopping capacity of the panels 1200 and 1250 is comparable to conventional ballistic resistant material having weights beginning at 10 pounds per square foot. Furthermore, the utilization of layers 1280 and 1290 and relatively thin projectile deformation layers 1260 and 1270 provides the unique capability that the material may be conformed to match the necessary contours. This is particularly critical for aircraft and vehicle fitting of ballistic panels where the surfaces are generally non-planar and require complex contouring to match the desired surfaces.

Figure 13A:
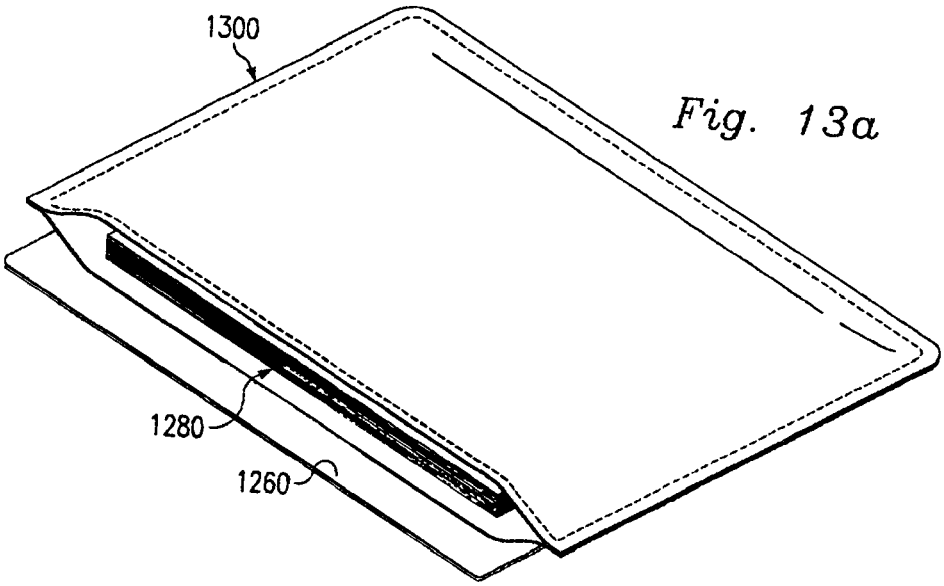
FIGS. 13(*a*) and 13(*b*) depict the panels of FIGS. 12(*a*) and 12(*b*) inserted within a protective sheath, respectively.
Figure 13B:
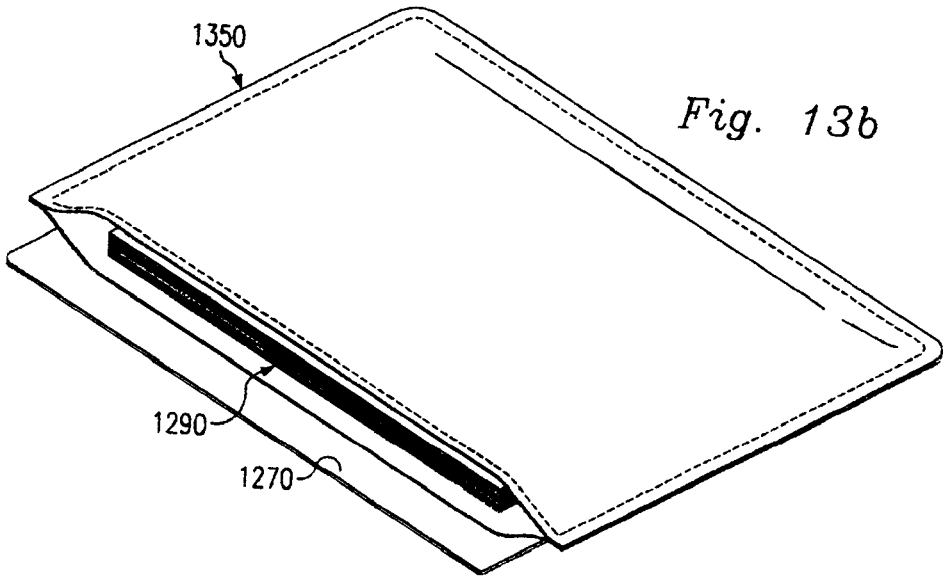

FIG. 13(*a*) depicts the panel 1200 further comprising a protective sheath 1300. The sheath 1300 may be constructed in a manner similar to those described in FIGS. 2, 5, 8, and 10. The layers 1280 of panel 1200 are inserted into the sheath 1300 while the projectile deformation layer 1260 is affixed to the bottom of the sheath. In a similar manner, FIG. 13(*b*) depicts the layers 1290 of panel 1250 inserted into a protective sheath 1350 with the projectile deformation layer 1270 affixed to the bottom of the sheath.

Figure 14A:
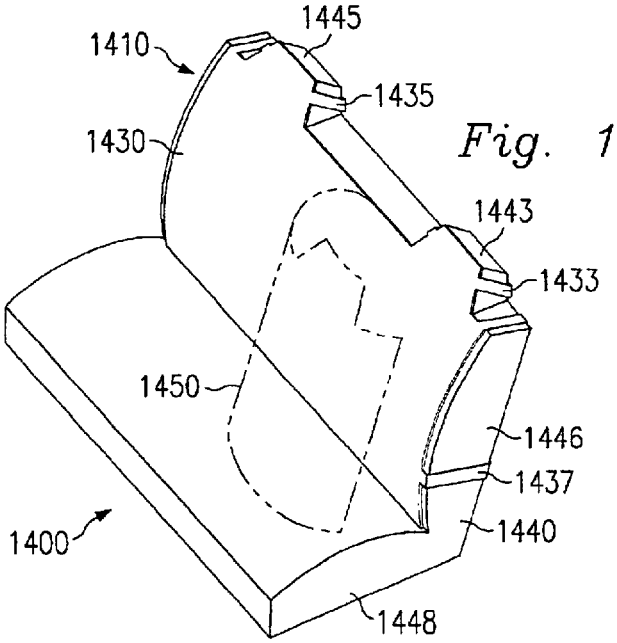
FIGS. 14(*a*) and 14(*b*) illustrate a ballistically modified seat cover according to another aspect of the present invention.
Figure 14B:
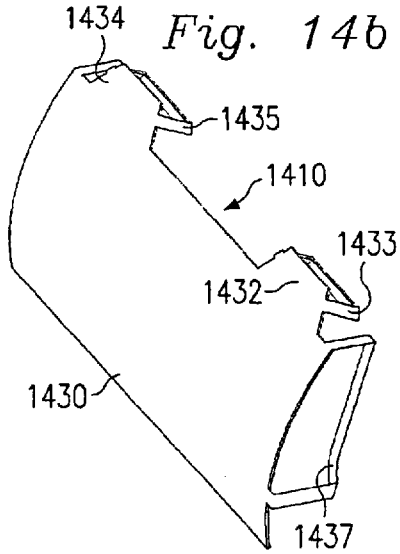

Referring now to FIGS. 14(*a*) and 14(*b*), there is shown a ballistically modified seat 1400 suitable for use in vehicles or other seating arrangements. Ballistically modified seat 1400 includes a penetration resistant seat cover 1410 that may be formed of a flexible penetration resistant material of the previously described embodiments. As shown in FIG. 14(*a*), in one aspect of the invention the seat cover 1410 is positioned between the user and the seat. The ballistically modified seat cover 1410 may be formed of the flexible penetration resistant panel Seat cover 1410 includes a seat back rest portion 1430, a first headrest extension 1432, and a second headrest extension 1434 formed of the same material as the back rest portion. Seat cover 1410 further contains attachment straps 1433, 1435, and 1437 for attaching the seat cover to the seat 1440. An attachment strap on the right-hand side consistent with the construction of strap 1437 is provided but not shown. More specifically, headrest strap 1433 is positioned around headrest 1443 and headrest strap 1435 is positioned around headrest 1445 to secure the seat cover 1410 to the seat 1440. Side strap 1437 is positioned around a portion of seat back rest 1446 to further secure the seat cover 1410 to the seat 1440. As shown in FIG. 14(*a*), seat cover 1410 may not extend to cover the seat portion 1448.

It will be understood that the ballistically modified seat cover 1410 can be constructed to conform to a variety of seats. Beyond providing ballistic protection in a conventional seating context, the seat cover 1410 may further be used as a ballistic shield 1450. Thus, the seat cover 1410 is quickly detachable from the seat 1400 and flexible enough to wrap around a user (not shown).

Figure 15A:
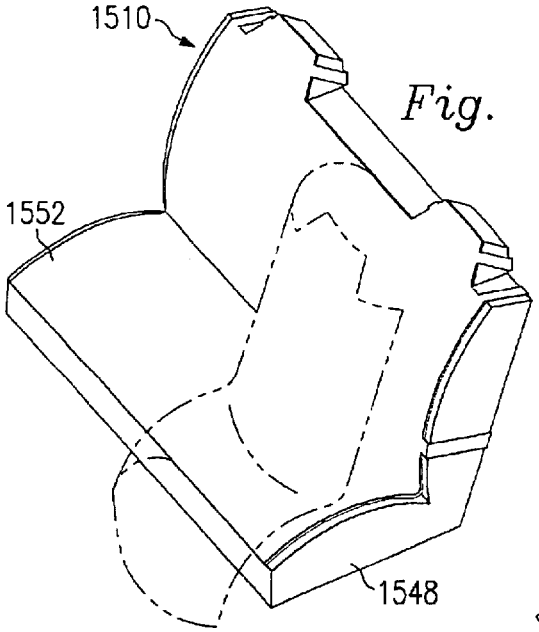
FIGS. 15(*a*) and 15(*b*) illustrate a further ballistically modified seat cover according to another aspect of the present invention.
Figure 15B:
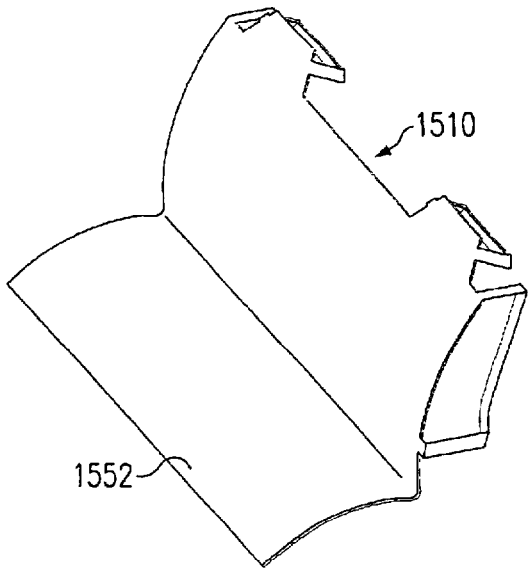

FIGS. 15(*a*) and 15(*b*) depict a further embodiment of the ballistically modified seat cover of FIGS. 14(*a*) and 14(*b*). More specifically, the ballistically modified seat cover 1510 further provides protection for the seat portion 1548 via the seat cover portion 1552.

Figure 16:
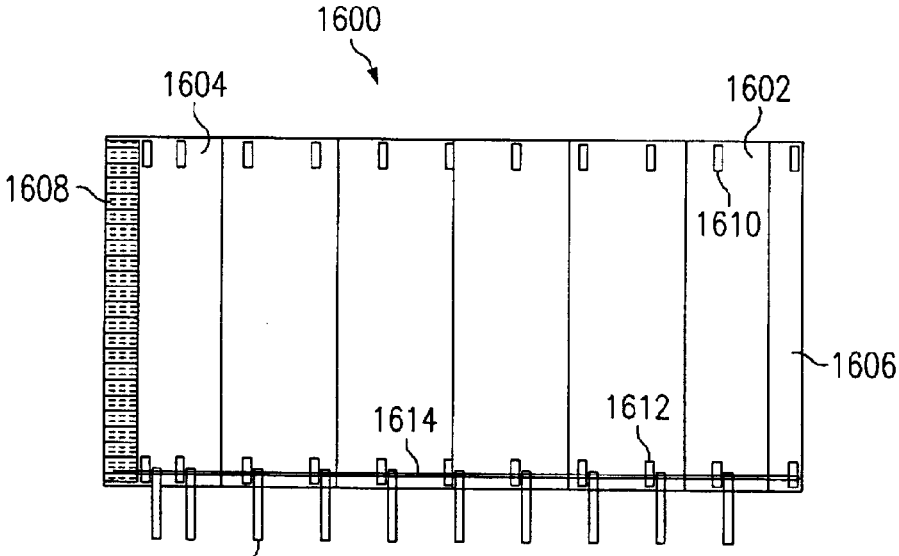
FIG. 16 illustrates a foldable anti-ballistic panel in accordance with another aspect of the present invention.

FIG. 16 illustrates a foldable panel 1600 in accordance with another aspect of the present invention. The foldable panel 1600 is formed of six individual panel sections joined to each adjacent section by a flexible connection permitting the panel to be folded accordion style to a much smaller shape. The panel may be formed to any desired dimensions, although a preferred dimension is four feet in height and eight feet in length. Each section of panel 1600 is formed of penetration resistant material. In one aspect, each section is formed of one or more coupons of the composite material shown in FIG. 11. In the expanded configuration illustrated in FIG. 16, each section has a portion of penetration resistant material that overlaps the adjacent section such that the junction between adjacent sections has penetration resistance equivalent to each of the sections. Further, one or more additional panels similar in construction to panel 1600 may be attached to foldable panel 1600 at section 1602 or section 1604. Section 1602 includes a pair of opposing tabs 1606 (only one shown) formed along the length of section 1602. The facing portions of tabs 1606 are lined with loop fastening material. In a corresponding manner, section 1604 includes a single projecting tab 1608 having its front and back surfaces covered with hook fastening material. It will be understood that tab 1608 may be positioned within opposing tabs 1606 and the tabs urged towards each other to form a hook and loop connection between projecting tab 1608 and tabs 1606. Further, each section of foldable panel 1600 includes at least one loop 1610 along the upper edge and a corresponding loop 1612 along the lower edge of foldable panel 1600. Preferably, loops 1610 and 11612 are formed of nylon webbing. As shown in FIG. 16, loop 1612 is formed to receive an elongated pole 1614 that is configured to extend through each of the lower loops. Still further, each section may include one or more attachment straps 1616. Such straps may be formed of nylon webbing and include hook and loop type fasteners for quick connection.

The folding panel 1600 may be conveniently folded for storage and transport to the needed location. It will be understood that folding panel 1600 may be collapsed along the flexible connection lines shown in FIG. 16 in an accordion like manner to substantially the size of panel 1604 in width and height. When needed, panel 1600 may be unfolded to substantially the size and shape shown in FIG. 16. The panel may be used as a blanket or hand held protective screen without the use of pole 1614. However pole 1614 and a similar pole may be installed through loops 1612 and 1610, respectively, to prevent folding of the panel. In this form, panel 1600 can be use by one or more individuals to provide ballistic protection from most firearms in a lightweight mobile design. It is contemplated that one use of the device of FIG. 16 is for rescue teams and emergency medical personnel to enter hostile environments using panel 1600 as a mobile shield. When rigid structures are nearby, straps 1616 may be used to join the panel to structures and vehicles to provide additional support.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A composite ballistic panel, comprising:

a first ballistic panel, comprising:

a at least one first layer formed of a woven ballistic resistant material;

at least one second layer formed of a non-woven ballistic resistant material;

a first series of connectors intermittently joining said at least one first layer and said at least one second layer; and a second series of connectors intermittently joining said at least one first layer and said at least one second layer;

wherein the first and second series of connectors define unconnected areas of material having a cumulative surface area substantially larger than the cumulative surface area of the connected material;

a second ballistic panel, comprising:

at least one first layer formed of a woven ballistic resistant material;

at least one second layer formed of a non-woven ballistic resistant material;

a first series of connectors intermittently joining said at least one first layer and said at least one second layer; and a second series of connectors intermittently joining said at least one first layer and said at least one second layer;

wherein the first and second series of connectors define unconnected areas of material having a cumulative surface area substantially larger than the cumulative surface area of the connected material; and a hard coupon, comprising:

a first layer formed of a ballistic resistant material; and a second layer formed of a ballistic resistant material;

wherein said first layer and said second layers are joined together via a laminate.

2. The composite ballistic panel of claim 1 further comprising a protective sheath.

3. The composite ballistic panel of claim 1 wherein said first series of connectors and said second series of connectors of said first ballistic panel are formed of materials selected from a group consisting of aramid polymers, polyolefins, polyethylene and polypropylene.

4. The composite ballistic panel of claim 1 wherein said first series of connectors and said second series of connectors of said first ballistic panel comprise a filament of cotton.

5. The composite ballistic panel of claim 1 wherein said first series of connectors and said second series of connectors of said second ballistic panel are formed of materials selected from a group consisting of aramid polymers, polyolefins, polyethylene and polypropylene.

6. The composite ballistic panel of claim 1 wherein said first series of connectors and said second series of connectors of said second ballistic panel comprise a filament of cotton.

7. The composite ballistic panel of claim 1 wherein said first ballistic panel includes a plurality of said first layers and a plurality of said second layers; in a ratio of at least three of said second layers to each one of said first layer.

8. The composite ballistic panel of claim 1 wherein said second ballistic panel includes a plurality of said first layers and a plurality of said second layers; in a ratio of at least three of said second layers to each one of said first layer.

9. The composite ballistic panel of claim 1 wherein the bounded areas of unconnected material of the first ballistic panel are bounded squares of unconnected material.

10. The composite ballistic panel of claim 1 wherein the bounded areas of unconnected material of the second ballistic panel are bounded squares of unconnected material.

11. The composite ballistic panel of claim 1 wherein the first ballistic panel further comprises connectors to join the perimeter of the layers.

12. The composite ballistic panel of claim 1 wherein the second ballistic panel further comprises connectors to join the perimeter of the layers.

13. A method for making a lightweight, composite ballistic panel, comprising the steps of:

providing a first ballistic panel, comprising the steps of:

aligning at least one layer formed of a woven ballistic resistant material and at least one layer formed of a non-woven ballistic resistant material in a stacked configuration; and interconnecting a small portion of the layers while leaving a substantially larger portion of the layers unconnected;

providing a second ballistic panel, comprising the steps of:

aligning at least one layer formed of a woven ballistic resistant material and at least one layer formed of a non-woven ballistic resistant material in a stacked configuration; and interconnecting a small portion of the layers while leaving a substantially larger portion of the layers unconnected;

providing a hard coupon formed of laminated layers of ballistic resistant material; and aligning the hard coupon with the first and second ballistic panels in a stacked configuration.

14. The method of claim 13 further comprising inserting the aligned hard coupon, first ballistic panel, and second ballistic panel into a protective sheath.

* * * * *